United States Patent [19]

Engle et al.

[11] 4,221,489

[45] Sep. 9, 1980

[54] SELF ALIGNING PAPER FEED ROLLER ASSEMBLY

[75] Inventors: Vencil D. Engle; Raymond M. Marowski; Edward E. Pollard; John L. Pullen, all of Lexington, Ky.

[73] Assignee: International Business Machines Corporation, Armonk, N.Y.

[21] Appl. No.: 957,942

[22] Filed: Nov. 6, 1978

[51] Int. Cl.[3] ..... B41J 13/02

[52] U.S. Cl. ..... 400/636.3; 400/637.5; 400/637.6; 400/647

[58] Field of Search ..... 400/636.1, 636.3, 637, 400/637.1, 637.2, 637.3, 637.4, 637.5, 637.6, 647

[56] References Cited

U.S. PATENT DOCUMENTS

| | | | |
|---|---|---|---|
| 1,453,579 | 5/1923 | Armstrong | 400/636.3 X |
| 1,453,582 | 5/1923 | Armstrong | 400/637.3 |
| 1,841,116 | 1/1932 | Garbell | 400/637.5 |
| 1,910,329 | 5/1933 | Going | 400/636.3 |
| 2,121,853 | 6/1938 | Bower | 400/636.1 |
| 2,218,108 | 10/1940 | Harmon | 400/637.2 |
| 2,297,490 | 9/1942 | Martin et al. | 400/647 |
| 2,848,092 | 8/1958 | Ostholm et al. | 400/637.2 X |

FOREIGN PATENT DOCUMENTS

| | | | |
|---|---|---|---|
| 971816 | 4/1959 | Fed. Rep. of Germany | 400/637.2 |
| 2124877 | 12/1972 | Fed. Rep. of Germany | 400/636.3 |

OTHER PUBLICATIONS

IBM Technical Disclosure Bulletin, "Paper-Handling Apparatus for Typewriter and Printers", Jenney et al., vol. 20, No. 12, May 1978, p. 5221.

*Primary Examiner*—Ernest T. Wright, Jr.
*Attorney, Agent, or Firm*—Laurence R. Letson

[57] ABSTRACT

A paper feed roll assembly is disclosed which is pivotally mounted on a central point with three degrees of freedom of movement. The feed rolls are engageable with the periphery of the platen. Additionally, the support for the paper feed rolls is deflectable about the central point by a feed roll release member to effect the withdrawal of the feed rolls from the periphery of the platen to enhance paper insertion and removal. The pivot point support provides for freedom of movement in the three necessary degrees of freedom to allow equilization of feed roll force against the platen and for alignment of the feed rolls with the periphery of the platen to insure proper paper feed. The feed roll truck frame, by virtue of its pivotal mounting, may be deflected downward to permit release or insertion of the paper. A deflection means or eccentric bar is disclosed for deflecting the truck member away from the periphery of the platen against the force of the pivot support acting toward the platen.

5 Claims, 3 Drawing Figures

SELF ALIGNING PAPER FEED ROLLER ASSEMBLY

BACKGROUND OF THE INVENTION

Typewriter platens are rigidly mounted in tightly fixed spacial positions so that the printing mechanism will impact the surface of the platen, and the printed sheet carried thereby, with an equal force at both ends of the relative travel of the printing mechanism with respect to the platen while permitting rotation of the platen. A significant problem in typewriter manufacture is the insuring of even, smoothly fed paper sheets. If there is an uneveness in the force exerted by the feed rolls against the platen or against the paper being fed around the platen, the paper will wrinkle and if the axis of the feed rolls is not parallel with that of the platen the effect will be to cause the paper to deviate from a straight feed path or skew and will work itself either to the left or right causing the printed lines to not correspond with a horizontal print line across the paper.

In order to insure that the feed rolls are positioned parallel to the axis of the platen and that the feed rolls exert equal forces against the platen, extensive adjustments and design effort must be made. It is conventional to support a bracket at a pivot point, which bracket in turn supports the end points of the axles upon which the feed rolls are mounted, thereby equalizing the forces between the front and rear feed rolls. The front to rear placement of the supports for the feed rolls has been traditionally through the tightening and loosening of bolts through lost motion slots or adjustment slots in the brackets, or tightly defined shaft support positions in the frame. If the parts are slightly out of proper fit the different pressures on the rollers will cause an improper feeding and must be adjusted by a trial and error technique.

Prior art feed roll devices by virtue of their design can only address one of the two significant problems. Either the feed roll must be supported in such a manner that it allows an automatic alignment of the roll with the platen such as that technique disclosed in U.S. Pat. No. 2,218,108 to Harmon wherein the feed roll support bracket or truck is permitted to pivot about a central point within a restricted plane, or the addressing of the problems of feed roll engagement force against the paper and platen by the spring biasing of the feed rolls by exertion of the spring force onto a portion of linkages which in turn support the feed roll end brackets.

Examples of prior art where the pivot points of the linkages will define the arc through which the feed rolls support brackets will move include Bower, U.S. Pat. No. 2,121,853; Martin et al. U.S. Pat. No. 2,297,490; Armstrong U.S. Pat. No. 1,453,582; Garbell U.S. Pat. No. 1,841,116 and Gerring U.S. Pat. No. 1,910,329. In each instance the pivot points of the support members must be adjusted or fabricated in the overall framework of the typewriter to insure exact parallelism between the axis of the feed rolls and that of the platen in order to insure proper and consistent paper feed. The spring biasing or other mechanical force exerted to cause the feed roller to engage the platen is such that it will provide the desired radial forces against the platen for proper paper feed, but may be unevenly exerted if the feed rolls are not positioned exactly parallel with the axis of the platen.

OBJECTS OF THE INVENTION

It is therefore, an object of the invention to align the axis of the feed rolls parallel to the axis of the platen by engagement of the feed rolls with the platen surface while simultaneously compensating for inequities of the engaging force of the feed rolls against the platen.

It is another object of the invention to maintain a locating point on the feed roll truck on a predefined spacial relationship to the platen axis to eliminate complex adjustments.

It is still a further object of the invention to disengage the feed rolls from the platen surface while maintaining the spacial position of the locating and pivot point of the feed roll truck with respect to the platen.

SUMMARY OF THE INVENTION

The foregoing objects of the invention are accomplished and the deficiencies of the prior art overcome by fixing the axes of the feed rolls parallel to themselves on a separate moveable truck member. The truck member has sufficient rigidity to maintain the parallelism between the forward and rear feed rolls. The truck member is pivotally mounted such that it has three degrees of freedom of movement. The pivot point can then be generally placed in the appropriate region and the rotation of the truck member around the pivot point will act to equalize the feed roll engagement with the platen, while rotation around an axis perpendicular to the axis of the platen will allow the feed rolls to self align themselves exactly parallel with the axis of the platen. Further, partial rotation around the pivot point will equalize the engaging radial forces between the feed rolls and the platen such that the force on each end of the feed roll axle will be substantially equal and thus engage the paper being fed around the platen equally, eliminating and minimizing malfunction and misfeeds.

A better understanding of the invention may be had by reference to the following detailed description and viewing the attached figures of the drawing.

THE DRAWING

DETAILED DESCRIPTION OF THE INVENTION

Figure 1:
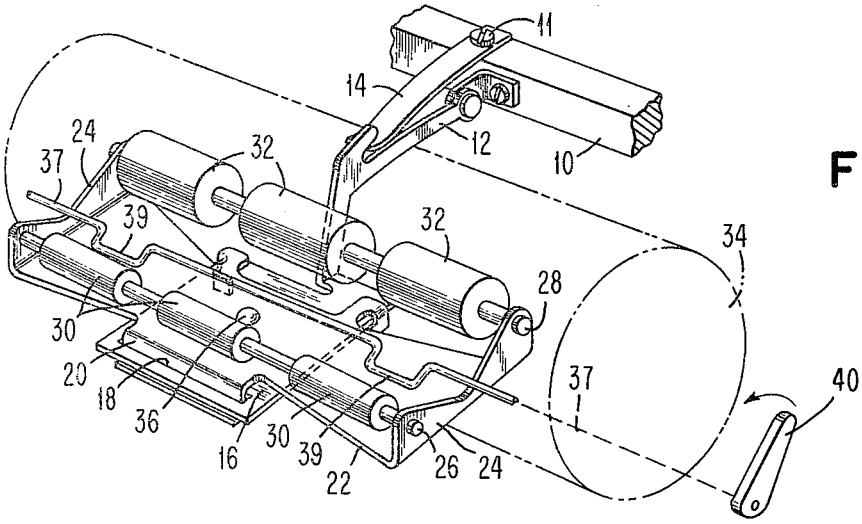
FIG. 1 illustrates the feed roll truck pivotally supported on a spring cantilevered support.

Referring to FIG. 1, a typewriter frame member 10 supports a pivotal mounting support arm 12. Acting to resiliently move the support arm 12 upward is cantilever leaf spring 14 mounted on frame member 10. by screw 11. Support arm 12 is shown as a portion of support and constraining member 16. The support arm 12 and support and constraining member 16 may be separately manufactured and then joined if desired. Member 16 is provided with an open slot 18 through which a tab 20, formed by bending a portion of plate and truck member 22 extends. The tab 20 inserted into slot 18 tends to restrict the movement of truck member 22 to a relatively stable zone of movement, during times when feed rolls 30, 32 are not engaged with platen 34, to prevent accidental disassembly or interference with nearby typewriter parts. The tab 20 and slot 18, when in operation, with the platen 34 inserted into the typewriter, is totally inaffective inasmuch as they do not engage each other. As such they are merely assembling and holding constraints. Truck 22 is provided with upstanding tabs 24 on either end which provide rotational supports to axles 26 and 28. Axles 26 and 28 respectively support the front and rear feed rolls 30, 32. The front feed rolls 30 may be of equal or smaller size than the rear feed rolls 32, depending upon design considerations dictated by the typewriter structure. Rear feed rolls 32 will generally be fixed to the axle 28 to insure that when one feed roll 32 drives the others will also drive, thus assisting in the paper feeding. Platen 34 when inserted into the machine will engage, in rolling fashion, front and rear feed rolls 30 and 32 respectively.

Truck 22 is provided with a recess formed in its lower surface and forming a raised portion 36 on the upper surface. A round or pointed member 44 may be inserted therein to provide a pivot point. Such a rounded or pointed member 44 is supported on member 16, and may or may not be adjustable with respect thereto.

Figure 3:
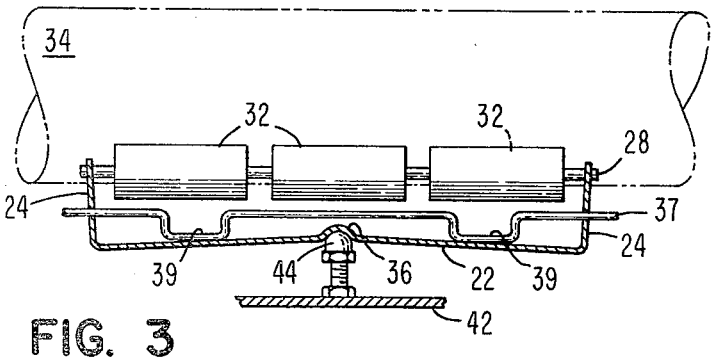
FIG. 3 is a section view along lines 3—3 in FIG. 2.

To release the feed rolls 30, 32 from the periphery of platen 34 eccentric rod or bail 37 having offset portions 39 is positioned across truck member 22. Control lever 40 is rigidly attached to rod 37 and rotates it under manual control. As offset portions or eccentrics 39 push down against truck member 22 it will cause truck member 22 to deflect and deform about pivot point 44. As the truck 22 does so the end tabs 24 of the truck 22 will move downward pulling axles 26 and 28, together with their respective feed rolls 30, 32 downward away from the surface of the platen 34. This arrangement insures a constant position of pivot point 44 whereby upon the release of the downward or retracting forces exerted by offset portion 39 against truck 22 by the reverse movement of lever 40, the truck 22 will resiliently rebound to its original configuration and thus re-exert radial pressure along the surface contact line between feed rolls 30, 32 and the periphery of platen 34. Referring to FIG. 3, it will be more clearly seen how the offset portions 39 of bail 37 cause the deflection of truck 22.

Figure 2:
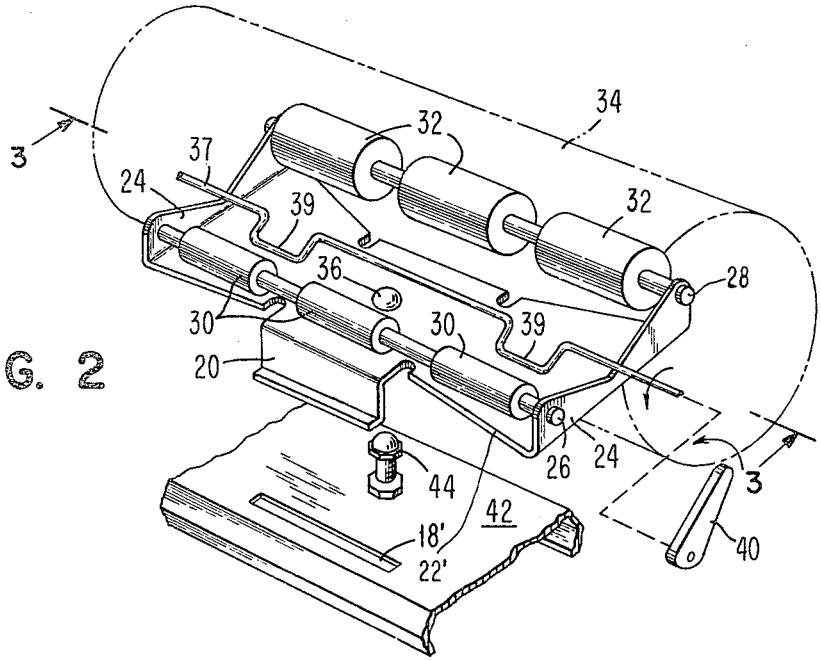
FIG. 2 illustrates the feed roll truck with a solid rail support for the pivot support point.

FIG. 1 specifically shows the mounting technique adapted for a typewriter or printer with a stationery platen 34. FIG. 2 illustrates the implementation of the invention into a typewriter with a moving paper carriage rail 42 and platen 34.

Referring to FIGS. 2 and 3, carriage rail 42 provides the mounting support for pivot member 44 with slot 18' constraining undue movement of tab 20 and truck 22. Pivot member 44 will engage the under surface of raised portion 36. Pivot member 44 may be adjusted with respect to its height above carriage rail 42 or member 16 in FIG. 1 to provide the desired force against the platen 34. By utilizing the deflection of truck 22 as a force generation mechanism analogus to deflecting a leaf spring, the feed roll forces against the surface of platen 34 may be initially set. FIG. 1 also has a supplementary adjustment by the choice of cantilever spring 14. By operating the paper release lever 40 the bail 37 is rotated to flex the truck 22 and thus relieve the forces between the pinch rolls or feed rolls 30, 32 from the surface of the platen 34 for the insertion or the removal of paper.

What is claimed is:

1. A feed roll assembly for a printer having a cylindrical platen, comprising:

support means attached to said printer, pivot means supported on said support means a fixed distance from said platen, feed rolls supportively mounted on a shaft, a truck means for supporting said shaft, a plurality of said shafts supported rotatively by said truck means with said shafts in a parallel relation to each other, said truck means comprising a pivot bearing surface, said pivot bearing surface engaged to provide three degrees of rotational freedom with said pivot means, and deflectable about said pivot means, release means engageable with said truck means for deflecting said truck means about said pivot means and away from said platen, whereby said feed rolls will align parallel with the axis of said platen, when engaged with said platen and said truck means will rotate to equalize the forces between said feed rolls and said platen.

2. The feed roll assembly of claim 1 wherein said release means comprises an eccentric member for engaging deflectable portions of said truck means to deflect said truck means about said pivot means.

3. The feed roll assembly of claim 2 wherein said release means comprises a manual control member operatively associated with said eccentric member.

4. The feed roll assembly of claim 1 wherein said feed rolls are fixedly attached to said shafts and said truck means supports said shafts for rotation.

5. The feed roll assembly of claim 1 wherein said release means comprises a manual control member operatively associated therewith.

* * * * *